US005344751A

United States Patent [19]

Carlson

[11] Patent Number: 5,344,751

[45] Date of Patent: * Sep. 6, 1994

[54] ANTISTATIC COATINGS

[75] Inventor: Robert L. Carlson, St. Paul, Minn.

[73] Assignee: Minnesota Mining and Manufacturing Company, St. Paul, Minn.

[ * ] Notice: The portion of the term of this patent subsequent to May 28, 2010 has been disclaimed.

[21] Appl. No.: 69,924

[22] Filed: May 28, 1993

[51] Int. Cl.[5] ..... G03C 1/85

[52] U.S. Cl. ..... 430/527; 430/272; 430/523; 430/510; 430/535; 430/539; 427/397.7; 427/397.8

[58] Field of Search ..... 430/272, 527, 523, 534, 430/539, 510; 427/397.7, 397.8

[56] References Cited

U.S. PATENT DOCUMENTS

| | | | |
|---|---|---|---|
| 3,492,137 | 1/1970 | Iler | 106/74 |
| 3,615,781 | 10/1971 | Schneider et al. | 106/84 |
| 4,266,016 | 5/1981 | Date et al. | 430/527 |
| 4,267,266 | 5/1981 | Shibue et al. | 430/530 |
| 4,495,276 | 1/1985 | Takimoto et al. | 430/527 |
| 4,863,801 | 9/1989 | Vallarino | 428/414 |
| 4,895,792 | 1/1990 | Aizawa et al. | 430/530 |
| 5,236,818 | 8/1993 | Carlson | 430/527 |

FOREIGN PATENT DOCUMENTS

| | | |
|---|---|---|
| 0301827 | 2/1989 | European Pat. Off. . |
| 0334400 | 9/1989 | European Pat. Off. . |
| 55-126239 | 9/1980 | Japan . |
| 58-062648 | 4/1983 | Japan . |
| 03271732A | 12/1991 | Japan . |
| 2075208 | 11/1981 | United Kingdom . |
| 2094013 | 9/1982 | United Kingdom . |

*Primary Examiner*—Jack P. Brammer

*Attorney, Agent, or Firm*—Gary L. Griswold; Walter N. Kirn; Thomas C. Lagaly

[57] ABSTRACT

A coating of a mixture of sodium metasilicate together with a silica sol and a silane coupling agent provides antistatic protection when overcoated with a gelatin containing photographic construction.

19 Claims, No Drawings

ANTISTATIC COATINGS

BACKGROUND OF THE INVENTION

Field of the Invention

The present invention relates to the prevention of static buildup on polymeric materials by the addition of antistatic layers to those materials. In particular, the invention relates to antistatic coatings in association with imageable materials.

BACKGROUND OF THE ART

Many different polymeric materials have been long recognized as suffering from electrostatic charge buildup during use. The problems associated with such static charging may be as modest as sparks from moving about on polymeric carpeting and popping sounds on phonograph records or as serious as memory erasure on computer disks and false artifacts in photographic film.

One usual method of reducing static buildup is the addition of a conductive layer or low surface resistivity layer to the polymeric article. It is common in the protection of shaped polymeric articles, including carpets, to treat the polymer with reactive or absorbable salts (e.g., U.S. Pat. No. 3,309,223 and 4,313,978). It is also known to form layers of inorganic metal oxides, either in film or particulate form to decrease the surface resistivity (e.g., U.S. Pat. No. 4,203,769 and 4,394,441). These antistatic coatings are known to be particularly desirable and useful as subbing layers in photographic articles (e.g., U.S. Pat. No. 3,874,879).

One other antistatic layer for photographic materials is described in EPO Application 0 301 827 A2 published Feb. 1, 1989 where a continuous gelled network of inorganic oxide particulates, including silica, are coated onto a substrate along with an ambifunctional silane to increase the wet adhesion of the antistatic layer to gelatin. These coatings tend to lose their antistatic properties when overcoated with a photographic construction because of penetration of gelatin into the pores of the layer.

Copending U.S. patent application Ser. No. 07/970,495, filed Nov. 2, 1992, describes a coating composition comprising sodium orthosilicate, colloidal inorganic oxide particulates such as silica, and a coupling agent (silane) which is applied to substrates to provide an antistatic layer. The orthosilicate provides an essentially continuous network or phase in the interstices of the particles which prevents extensive penetration of the space between colloidal silica so that antistatic properties can be maintained, even after a further coating is applied to the antistatic layer. Such further coating may be gelatin layers such as photographic emulsion layers or auxiliary photographic layers.

SUMMARY OF THE INVENTION

A coating composition comprising sodium or potassium metasilicate, colloidal inorganic oxide particulates such as silica, and a coupling agent (silane) is applied to substrates to provide an antistatic layer. The metasilicate provides an essentially continuous network or phase in the interstices of the particles which prevents extensive penetration of the space between colloidal silica so that antistatic properties can be maintained, even after a further coating is applied to the antistatic layer. Such further coating may be gelatin layers such as photographic emulsion layers or auxiliary photographic layers.

DETAILED DESCRIPTION OF THE INVENTION

The antistatic coatings of the present invention are particularly beneficial and capable of a broad range of use at least in part because of their optical transparency when overcoated, water-insolubility, and ability to dissipate a static charge even after being overcoated. Optical transparency is important when the protected substrate or article is to be imaged, viewed, or projected. Water insolubility is significant where the antistatic layer is a surface layer or the article is to be treated or processed in aqueous solutions. Dissipation of a static charge is an indication of the degree of efficiency which the antistatic layer is capable of providing.

The antistatic protective layer of the present invention comprises a layer of at least three components. The three components are in a single coating composition and comprise 1) an alkali metal metasilicate, 2) colloidal silica particles and 3) coupling agents capable of reacting with the silica particles (a compound having at least two groups one of which is capable of bonding with inorganic oxide particles).

The coupling agents are materials well known in the art, as represented by EPO Application 0 301 827 A2. Those silanes are ambifunctional silane coupling agents represented by the formula:

$$(Q)_n—R—Si(OR^1)_3$$

wherein $R^1$ is alkyl or aryl,

R is an organic group with (n+1) external bonds or valences, n is 0, 1 or 2, and Q is a moiety reactive with photographic hardeners or directly with gelatin (e.g., alpha-amino acids).

Preferably $R^1$ is alkyl of 1 to 10 carbon atoms and most preferably 1 to 4 carbon atoms. R is preferably an aliphatic or aromatic bridging group such as alkylene, arylene, alkarylene, or aralkylene which may be interrupted with ether linkages (oxygen or thioethers), nitrogen linkages, or other relatively inert moieties. More preferably R is alkylene of 1 to 12 carbon atoms, preferably 2 to 8 carbon atoms, with n equal to 1. Q is preferably epoxy, or amino, primary or secondary, more preferably epoxy.

Where previously indicated that the second functional group may be present as a multiple number of such groups it is meant that the moiety $(Q)_n$—R— may include moieties such as $$NH_2—(CH_2)_2—NH(CH_2)_2—NH—(CH_2)_3—$$

$$NH_2—(CH_2)_3—$$

$$(NH_2)_2—CH—CH_2$$

$$\begin{array}{l} (NH_2)—CH_2 \\ \qquad\qquad \diagdown \\ \qquad\qquad\quad CH— \\ \qquad\qquad \diagup \\ (NH_2)—CH_2 \end{array}$$

and the like.

U.S. Pat. No. No. 4,879,175 also extensively describes coupling agents, particularly commercially available titanate and silane coupling agents.

One measurement of antistatic property is the surface resistivity of a coating. The units for measuring surface resistivity are ohms per square. The measurement relates to the ability of the coating to dissipate surface static electric charges. The lower the resistivity, the better that property is. Surface resistivity numbers in the $10^9$–$10^{11}$ ohms/sq range are considered to be 'good' for static protection. The other measurement used in determining antistatic protection is that of charge decay. In measuring this quality, an electric charge (measured in volts) is applied to the surface of the film and the time in seconds for the electric field generated to decay to zero is measured. For excellent static protection, the charge decay time (+5000 v to '0') should be less than two seconds, and preferably less than 0.5 second.

In this invention, poorly conductive coatings, such as a gelatin matrix containing, e.g., a photographic silver halide emulsion or an antihalation dye, are applied over the antistatic coating. Thus, low surface resistivity is not directly important in this invention because the surface of the antistatic coating is buried under non-conducting materials. Nevertheless, static protection is provided in an indirect manner insofar as the conductive layer is able to neutralize the external electric field of the surface static charges by formation of an internal electric field. This type of protection is effective for, e.g., the prevention of 'static cling' between sheets and with dust particles. This type of static protection is particularly notable in some commercial film, which have relatively poor surface resistivity ($10^{13}$ ohms/sq), but extremely low charge decay times. Other new photographic films have both good charge decay and surface resistivity properties.

An important distinction among antistatic coatings is the type of conductor. They can be either ionic conductors or electronic conductors. In general, if the surface resistivity and charge decay properties depend on the amount of moisture in the air, the coating is termed an ionic conductor, and if the properties do not depend on humidity, it is an electronic conductor.

The colloidal inorganic oxide solution or dispersion used in the present invention comprises finely divided solid silica particles mixed with sodium metasilicate in a liquid. The term "solution" as used herein includes dispersions or suspensions of finely divided particles of ultramicroscopic size in a liquid medium. The solutions used in the practice of this invention are clear in appearance.

The colloidal coating solution preferably contains about 0.5 to 5.0 weight percent, more preferably about 1.5 to 3.5 weight percent, colloidal silica particles and sodium metasilicate. At particle concentrations above about 5 weight percent, the resulting coating may have reduced uniformity in thickness and exhibit opacity and reduced adhesion to the substrate surface. Difficulties in obtaining a sufficiently thin coating to achieve increased light transmissivity may also be encountered at concentrations above about 5 weight percent. At concentrations below 0.5 weight percent, process inefficiencies result due to the large amount of liquid which must be removed and beneficial properties may be reduced.

The thickness of the applied wet coating solution is dependent on the concentration of silica particles and alkali metal metasilicate in the coating solutions and the desired thickness of the dried coatings. The thickness of the wet coating solution is preferably such that the resulting dried coating thickness is from about 25 to 1000 nm, more preferably the dried coating is about 100 to 350 nm thick.

The coating solution may also optionally contain a surfactant to improve wettability of the solution on the substrate, but inclusion of an excessive amount of surfactant may reduce the adhesion of the coating to the substrate. Suitable surfactants for this system would include compatible surface-tension reducing organic liquids such as n-propanol, and non-ionic surfactants such as those sold under the commercial names of Triton® X-100 and 10G. Generally the surfactant can be used in amounts of up to about 0.5 weight percent of the solution.

The average primary particle size of the colloidal inorganic oxide particles is generally less than 50 nm, preferably less than 20 nm, and more preferably less than 10 nm. Some very useful commercial colloidal suspensions have average primary particle sizes less than 7 nm. Such colloidal suspensions, e.g., colloidal silica, may be stabilized by sodium hydroxide or ammonia solutions. Examples of commercially available colloidal inorganic silica solutions are Ludox® SM30, Remasol® SP-30, and Nalco 2326.

In each of the following examples, the method used to measure the effectiveness of the antistatic layer employed an ets® Static Decay Meter, Model #406C that was utilized to measure the time in seconds for an applied surface electric charge of +5000 volts (+5.0 Kv) to decay to 'zero' (0.0 Kv).

EXAMPLE 1

A mixture was prepared by dissolving 1.71 grams of sodium metasilicate ($Na_2SiO_3$), purchased from Huls America, Inc., in 180 grams of deionized water and adding with stirring 13.5 grams of 32% colloidal silica (Remasol® SP-30, commercially available from Remet Corp.). The mixture was allowed to stand 1 hour at room temperature. Additions were then made of 0.26 grams of 3-glycidoxypropyl trimethoxysilane and 0.15 grams of a 10% solution of the surfactant sold under the trade name of 10G (commercially available from Union Carbide) . A second mixture was prepared in the same manner with the exception that the sodium metasilicate was omitted. The 2 mixtures were coated onto poly(ethylene terephthalate) primed with a copolymer of polyvinylidene chloride/ethyl acrylate/itaconic acid ("PVDC") using a #12 wire wound rod and drying the coating for 2 minutes at 55° C. The resultant coatings were allowed to stand overnite at room temperature and then overcoated with a gelatin antihalation ("AH") dye mixture containing a vinyl sulfone as the gelatin cross linking agent. This mixture was coated using a #24 wire wound rod and dried for 2 minutes at room temperature followed by 2 minutes at 55° C. The coatings were then conditioned at 20% relative humidity and 20° C. for 30 hours. The static decay was measured on the ets® Static Decay Meter as the time required to decay from a charge of +5.0 Kv to 0.0 Kv.

ets® Static Decay Measurements

| Sample | Sample Description | Decay Time |
|---|---|---|
| A | Construction w/ $Na_2SiO_3$ | .18 sec. |
| B | Construction w/o $Na_2SiO_3$ | .70 sec. |

-continued

| Sample | ets ® Static Decay Measurements<br>Sample Description | Decay Time |
|---|---|---|
| C | A overcoated w/AH | .05 sec. |
| D | B overcoated w/AH | ∞[1] |

[1] ∞ indicates the construction is an insulator and does not discharge to 0 Kv.

The above results demonstrate the effectiveness of the sodium metasilicate in imparting an antistatic property even after being overcoated with a gelatin containing mixture.

The overcoated samples were tested 1 hour after coating for wet adhesion by immersion for 30 seconds in a graphic arts RPD developer/replenisher, removing, scoring in a cross hatch pattern with the tip of a razor blade, and then rubbing in a back and forth manner 16 times. The construction with the sodium metasilicate had no evidence of adhesion failure whereas the construction without the sodium metasilicate had complete removal of the gelatin-containing overcoat.

EXAMPLE 2

A mixture was prepared by adding 27.0 grams of a 15% colloidal silica solution stabilized by ammonia (Nalco 2326) to 180 grams of deionized water and, in turn, adding 1.71 grams of sodium metasilicate purchased from Huls America, Inc. After dissolving the sodium metasilicate, additions were made of 0.26 grams of 3-glycidoxypropyl trimethoxysilane and 0.15 grams of a 10% solution of the surfactant 10G (DuPont). This mixture was allowed to stand 2 hours at room temperature and then coated as described in Example 1 The coating was allowed to stand 2 days at room temperature and then overcoated as described in Example 1. The overcoated sample was then conditioned 48 hours at 20% relative humidity and 20° C, and the static decay was read on the ets ® Static Decay Meter and found to be 0.08 sec. with decay from +5.0 Kv to 0.0 Kv. The wet adhesion was tested as described in Example 1 and no failure was in evidence.

EXAMPLE 3

The mixture described in Example 2 was coated after standing 30 min., 2 hours, 7 hours and 30 hours by the method described in Example 1. These constructions were in turn overcoated with a mixture of gelatin and an antihalation dye with a vinyl sulfone cross linking agent added. The overcoat was made by the procedure described in Example 1. The overcoated samples were condition 18 hours at 20% relative humidity and 20° C., and the static decay from +5.0 Kv to 0.0 Kv read on the ets ® Static Decay Meter. The decay times measured are given in the table below.

| Sample | ets ® Static Decay Measurements<br>Age of Mixture | Decay Time |
|---|---|---|
| A | 30 min. | .12 sec. |
| B | 2 hours | .15 sec. |
| C | 7 hours | .14 sec. |
| D | 0 hours | .17 sec. |

The samples A–D were tested for wet adhesion by the method described in example 1 but in both X-ray developer/replenisher and in graphic arts developer/replenisher and all samples were found to be without any evidence of failure.

EXAMPLE 4

A mixture was prepared by dissolving 1.71 grams of sodium metasilicate in 180 grams of deionized water and in turn adding 13.5 grams of colloidal silica (Remasol ® SP-30), 0.354 grams of 3-glycidoxypropyl trimethoxysilane, and; 0.15 grams of a 10% solution of the surfactant 10G. Another mixture was prepared in the same way with the exception that the colloidal silica was omitted. The two mixtures were allowed to stand at room temperature for 2 hours and then coated onto PVDC primed poly(ethylene terephthalate) in the manner described in Example 1. The coatings were allowed to stand overnite and then overcoated with a gelatin antihaltion dye mixture to which was added a formaldehyde cross linking agent in such an amount that the gelatin to formaldehyde ratio was 21:1. This mixture was coated by the method described in Example 1.

A sample of each coating was immersed in running water for 5 to 10 seconds to remove the antihaltion dye and then immersed for 60 seconds in a solution containing 555 mg per liter of anhydrous calcium chloride. The samples were then dried 90 seconds at 55° C. These samples together with the others were placed in a conditioning room at 25% relative humidity and 20° C. for 16 hours and then read on the ets ® Static Decay Meter to measure the decay time from 5.0 Kv to 0.0 Kv.

| Sample | ets ® Static Decay Measurements<br>Sample Description | Decay Time |
|---|---|---|
| A | construction w/silica | .06 sec. |
| B | construction w/o silica | ∞[2] |
| C | A overcoated w/AH | .07 sec. |
| D | B overcoated w/AH | ∞[2] |
| E | C immersed in $CaCl_2$ | 4.5 sec. |
| F | D immersed in $CaCl_2$ | ∞[2] |

[2] ∞ indicates the construction is an insulator and does not discharge to 0 Kv.

The above results demonstrate the importance of the mixture of colloidal silica in combination with sodium metasilicate in producing an antistatic coating that maintains the antistatic properties of the overcoated construction even after immersion in a calcium chloride solution.

EXAMPLE 5

Coatings similar to those of Example 1 were made with commercially available liquid potassium metasilicate available as KASIL ® Liquid #1 from the PQ Corporation. The best antistatic coatings were those having a colloidal silica to silicate ratio ranging from about 1:1 to about 2:1.

Other commercial metasilicates, such as that available from Eastman Kodak (sodium metasilicate-9 hydrate), were also found to be useful. Lithium metasilicate displayed low solubility in water and was therefore not believed to be commercially useful.

What is claimed is:

1. A method for providing an antistatic protection layer onto a substrate comprising:

a) preparing a coating composition in an aqueous medium of a colloidal silica, alkali metal metasilicate, and a coupling agent for said colloidal silica, said coating composition containing a colloidal silica to alkali metal metasilicate ration of 0.5/1 to 8.5/1 by weight;

b) applying said composition to said substrate; and c) drying said composition to form an antistaic protection layer having a thickness of from 25 to 1000 nm.

2. The method of claim 1 wherein the alkali metal metasilicate is potassium or sodium metasilicate.

3. The method of claim 2 wherein the coating composition contains a colloidal silica to sodium metasilicate ratio of 1.7/1 to 3.0/1 by weight.

4. The method of claim 1 wherein the colloidal silica employed is stabilized by a compound selected from the group consisting of sodium hydroxide and ammonia.

5. The method of claim 1 wherein the coupling agent comprises a silane coupling agent.

6. The method of claim 1 wherein the coupling agent is 3-aminopropyltriethoxy silane.

7. The method of claim 1 wherein the coupling agent is 3-glycidoxypropyl trimethoxy silane.

8. The method of claim 1 wherein the percent solids of the coating composition, expressed as colloidal silica plus sodium metasilicate, ranges from 0.5% to 5.0%.

9. The method of claim 8 wherein the percent solids of the coating composition, expressed as colloidal silica plus sodium metasilicate, ranges from 2.0% to 4.0%.

10. The method of claim 1 in which the pH of the coating composition ranges from 10.0 to 12.0.

11. The method of claim 1 in which the pH of the coating composition is adjusted with nitric acid.

12. The method of claim 1 wherein drying of said composition forms a film having a thickness of from 100 to 350 nm.

13. The method of claim 1 wherein said antistatic coating of claim 1 is overcoated with a gelatin matrix.

14. The method of claim 13 wherein said gelatin matrix contains a photographic silver halide emulsion or an antihalation dye.

15. The method of claim 13 wherein the gelatin matrix contains a polyalkyl acrylate latex.

16. The method of claim 15 wherein the polyalkyl acrylate is present in a weight ratio of polyalkyl acrylate to gelatin of from 0.05/1 to 1.0/1.

17. The method of claim 14 wherein the gelatin matrix contains a photographic silver halide emulsion or an antihalation dye and a polyalkyl acrylate latex.

18. The method of claim 1 wherein said alkali metal metasilicate is potassium metasilicate, and wherein the ratio of colloidal silica to potassium metasilicate ranges from about 1:1 to about 2:1.

19. The method of claim 1 wherein the alkali metal metasilicate comprises sodium metasilicate, the coupling agent comprises 3-glycidoxypropyltrimethoxy silane, and the substrate comprises poly(ethylene terephthalate).

* * * * *